United States Patent [19]

Yamanaka et al.

[11] Patent Number: 5,002,815

[45] Date of Patent: Mar. 26, 1991

[54] BULKY AND REINFORCED NON-WOVEN FABRIC

[75] Inventors: Akira Yamanaka; Yasuhiro Yabuuchi, both of Moriyama, Japan

[73] Assignee: Chisso Corporation, Ohsaka, Japan

[21] Appl. No.: 300,322

[22] Filed: Jan. 23, 1989

[30] Foreign Application Priority Data

Feb. 2, 1988 [JP] Japan ..... 63-22319

[51] Int. Cl.[5] ..... B32B 3/22; B32B 3/28; B32B 5/10; B32B 5/12

[52] U.S. Cl. ..... 428/109; 156/85; 428/112; 428/152; 428/172; 428/294; 428/913

[58] Field of Search ..... 428/152, 913, 172, 109, 428/112, 294; 156/85

[56] References Cited

U.S. PATENT DOCUMENTS

| | | | |
|---|---|---|---|
| 3,597,299 | 8/1971 | Thomas et al. | 428/110 |
| 3,639,199 | 2/1972 | Brandts et al. | 156/85 |
| 3,682,755 | 8/1972 | Lee | 156/85 |
| 4,525,407 | 6/1985 | Ness | 428/152 |
| 4,606,964 | 8/1986 | Wideman | 156/85 |
| 4,734,311 | 3/1988 | Sokolowski | 428/152 |
| 4,762,581 | 8/1988 | Stancliffe et al. | 156/85 |
| 4,847,134 | 7/1989 | Fahrenkrug et al. | 428/913 |
| 4,863,779 | 9/1989 | Daponte | 428/152 |

*Primary Examiner*—James C. Cannon

*Attorney, Agent, or Firm*—Fay, Sharpe, Beall, Fagan, Minnich & McKee

[57] ABSTRACT

A bulky and reinforced non-woven fabric and a process for producing the fabric are provided, which fabric is composed of a web consisting of 30–100% by weight of hot-melt-adhesive fibers and 70–0% by weight of fibers having a m.p. higher than that of the hot-melt-adhesive component of the hot-melt-adhesive fibers and monofilaments, fibers constituting the web being adhered onto one another and also to the monofilaments and the fabric having wrinkles at a wavelength of 0.1 to 20 mm over the whole surface of the fabric; and which process comprises arranging monofilaments of a percentage of shrinkage of 20% or higher under heat treatment conditions for melt-adhering the hot-melt-adhesive fibers over the whole surface of the web; adhering the fibers constituting the web onto one another and also to the monofilaments through hot-melt-adhesion; and also causing the web to shrink through shrinkage generated in the monofilaments.

8 Claims, 2 Drawing Sheets

A
B
C
D
E
I
II
III
1
2
3
4
5
6
7
8
9
10
11
12
13
14
15
16
18
19
20

BULKY AND REINFORCED NON-WOVEN FABRIC

BACKGROUND OF THE INVENTION

1. Field of the Invention

This invention relates to a non-woven fabric produced according to a hot-melt adhesion process and having a superior bulkiness and strength.

2 Description of the Related Art

Heretofore, as processes for producing non-woven fabrics using hot-melt adhesive fibers, heated roll process, hot-air-blowing process, etc. have been known, and non-woven fabrics having a basis weight of 15 to 200 g/m$^2$ have been used in the fields of surface materials for disposable diaper interlining fabrics, disposable clothes, etc.

However, non-woven fabrics produced by conventional processes have been in the form of a thin and flat sheet, deficient in bulkiness and also insufficient in strength. In order to improve the strength of non-woven fabrics, if the temperature and pressure at the time of heat treatment are raised, the non-woven fabrics become thinner and stiffer so that the bulkiness is lost. Processes for improving the strength of non-wove fabrics by incorporating reinforcing fibers thereinto are disclosed in Japanese patent application laid-open No. Sho 61-41357/1986 or Japanese patent application laid-open No Sho 62-215057/1987, but even according to these processes, it is impossible to improve the bulkiness of non-woven fabrics.

As a process for imparting the bulkiness to non-woven fabrics having a low basis weight, there has been known a process of providing crepe-like lateral wrinkles on non-woven fabrics by peeling off non-woven fabrics from a drum by employing a doctor knife in the suction drum dryer process. However, non-woven fabrics obtained according to this process, the bulkiness is improved, but the fabrics have such drawbacks that they are easily elongated by slight tension in the longitudinal direction and liable to be deformed.

SUMMARY OF THE INVENTION

The present inventors have made extensive research in order obtain a non-woven fabric by to a hot-melt adhesive process and having a high strength and a bulkiness, and as a result have achieved the present invention.

The present invention in a first aspect resides in;

a bulky and reinforced non-woven fabric composed of a web consisting of 30 to 100% by weight of hot-melt-adhesive fibers and 70 to 0% by weight of fibers having a melting point higher than that of the hot-melt-adhesive component of said hot-melt-adhesive fibers and monofilaments, fibers constituting said web being adhered onto one another and also said fibers constituting said web and said monofilaments being adhered together through hot-melt adhesion and said non-woven fabric having wrinkles which have been generated by heat shrinkage of said monofilaments, of a wavelength in terms of a distance between adjacent wrinkles, of 0.1 to 20 mm, over the whole surface of said non-woven fabric.

The present invention in a second aspect resides in;

a process for producing a bulky and reinforced non-woven fabric, which process comprises arranging over the total surface of a web consisting of 30 to 100% by weight of hot-melt-adhesive fibers and 70 to 0% by weight of fibers having a melting point higher than that of the hot-melt-adhesive component of said hot-melt-adhesive fibers, monofilaments having a percentage of shrinkage of 20% or higher under heat treatment conditions for melt-adhering said hot-melt-adhesive fibers; adhering fibers constituting said web onto one another and also adhering said monofilaments onto fibers constituting said web through hot-melt adhesion; and also causing said web to shrink through shrinkage generated in said monofilaments.

DETAILED DESCRIPTION OF PREFERRED EMBODIMENTS

Figure 1:
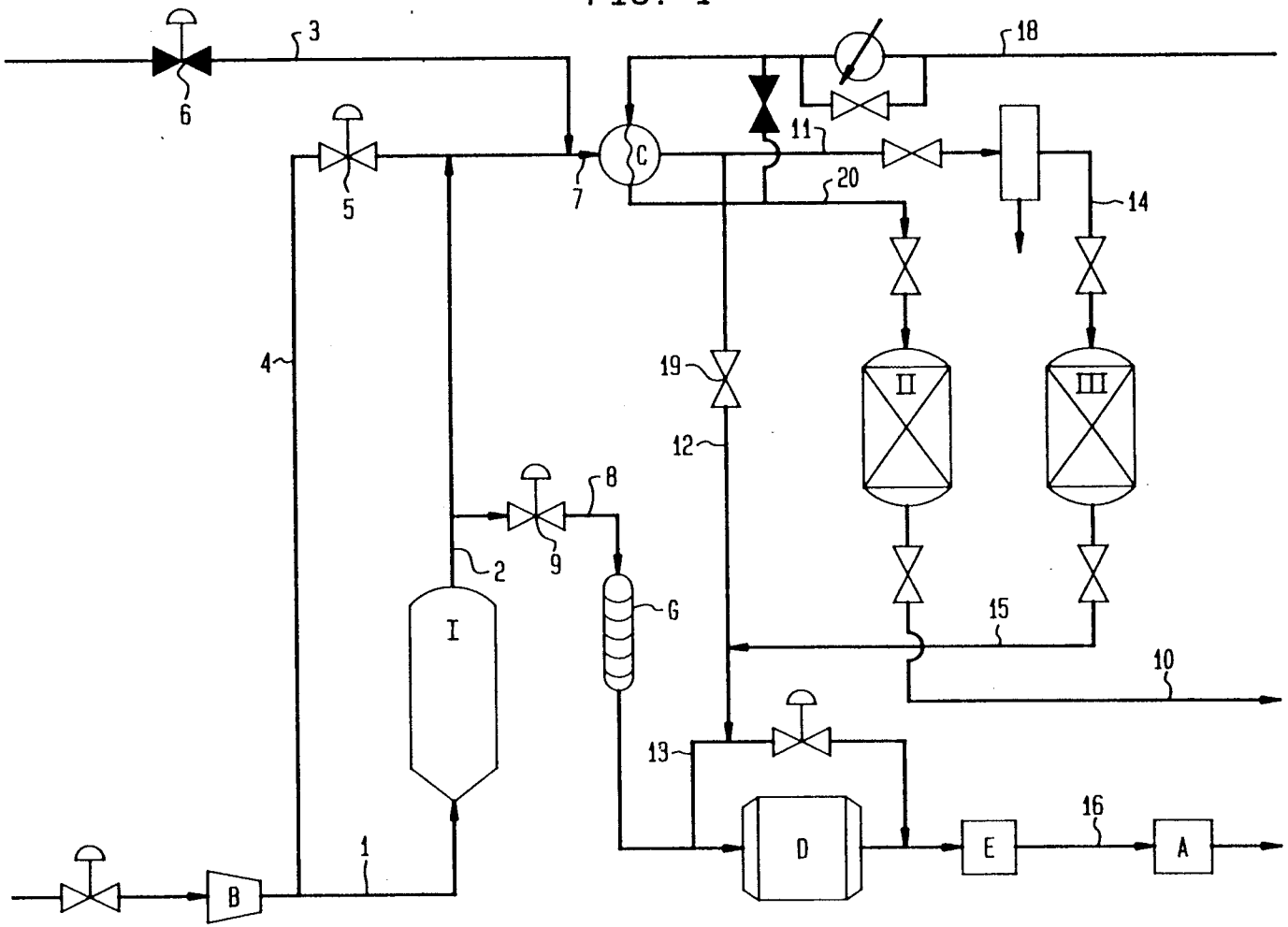
Figure 2:
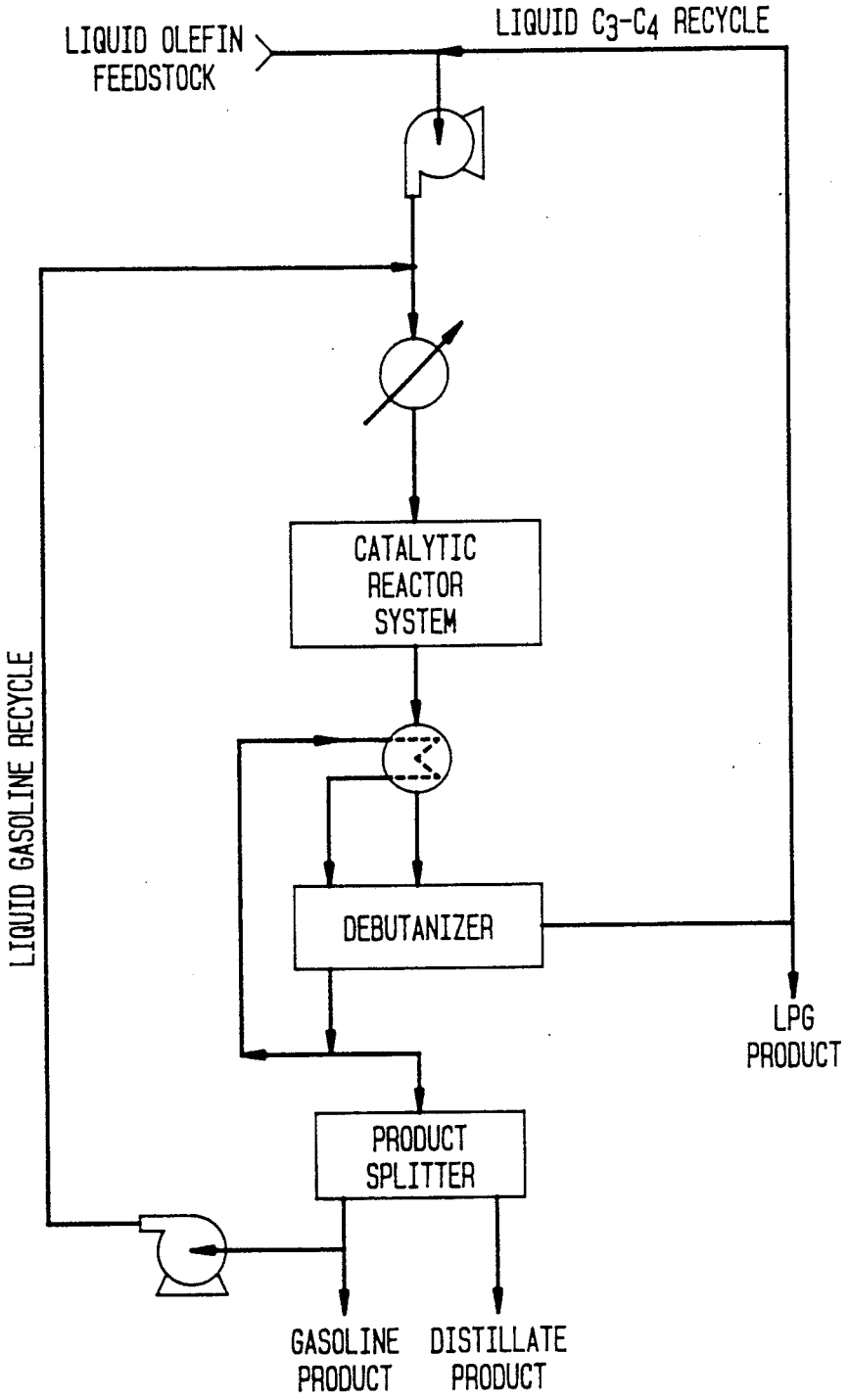

The hot-melt-adhesive fibers used in the present invention refer to homogeneous fibers consisting of thermoplastic resins such as polyethylene, crystalline polypropylene, low-melting polyesters, etc. or composite fibers consisting of thermoplastic resins having different melting points such as crystalline polypropylene/polyethylene, polyester/polyethylene, polyester/low-melting polyester, etc., these homogeneous or composite fibers generating hot-melt-adhesive properties through heat treatment. The fineness thereof has no particular limitation, but usually those of 1.5 to 30 d/f (denier/filament) are used depending on the required properties for particular use of non-woven fabrics.

In the case where the hot-melt-adhesive fibers are homogeneous fibers, the whole of the fibers is a hot-melt-adhesive component and there is a fear that the fibers melt depending on heat treatment conditions to lose the fiber shape; hence it is preferred to prepare a web blending the hot-melt-adhesive fibers with other fibers having a melting point higher than the above heat treatment temperature.

In the case where the hot-melt-adhesive fibers are composite fibers composed of thermoplastic resins having different melting points, it is possible to subject the fibers to heat treat melting lower-melting thermoplastic resin component alone as the hot-melt-adhesive component. Thereby it is possible to prepare the web from the composite fibers alone, but if desired, it is also possible to prepare the web by blending the hot-melt-adhesive fibers with other fibers having melting points higher than that of the above-mentioned lower-melting thermoplastic resin. Such other fibers used in admixture with these hot-melt-adhesive fibers will often be abbreviated to higher-melting fibers.

Examples of such higher-melting fibers are natural fibers such as cotton, hemp, wool, etc., and man-made fibers such as nylons, polyesters, rayon, etc., and these fibers may be blended in the web up to at most 70% by weight. If the content of the hot-melt-adhesive fibers in the web is less than 30% by weight, the melt-adhered points between the fibers are reduced to lower the strength of the non-woven fabric or increase occurrence of fluffs.

The above-mentioned hot-melt-adhesive fibers or the blend thereof with the higher-melting fibers is made up into a web having a desired basis weight by means of a so far known carding machine or random webber. It is possible to subject the resulting web to heat treatment as it is, but it is preferred to expose it at a temperature close to the melting point of the hot-melt-adhesive component of the hot-melt-adhesive fibers for a short time to cause adhered points to generate between fibers in advance (this process will often be abbreviated to pretreatment), since this pretreatment is able to stabilize the shape of the web and to exert the shrinkage of the monofilaments evenly over the whole of the web. For the pretreatment, any of known means such as infrared heating, hot air heating, heated rolls, etc. may be employed.

The monofilaments used in the present invention refer to those having a percentage of shrinkage of 20% or higher under heat treatment conditions for converting the web into a non-woven fabric and can be obtained by stretching unstretched monofilaments prepared by melt-spinning thermoplastic resins at a low stretching ratio of 1.5 to 2.5 times the original length at a relatively low temperature in the vicinity of room temperature. Further, when the thermoplastic resins used have a broad molecular weight distribution, monofilaments having a high percentage of shrinkage are easily obtained. The fineness of such monofilaments has no particular limitation, but usually those of 30 d/f or more are preferably used since it is necessary to exert the shrinking force thereof as far as the web. Further, it is preferred for the monofilaments to use a stock having a good adhesion to the hot-melt-adhesive fibers in the web, and it is also preferred to use thermoplastic resins of the same kind as that of the hot-melt-adhesive fibers (or the lower-melting resins thereof in the case of composite fibers).

The monofilaments are arranged uniformly over the whole surface of the web. As the arrangement pattern, the following are illustrated: two groups of the monofilaments are arranged in the length direction of the web and in the direction perpendicular thereto, respectively, to make a lattice pattern, or arranged each in the direction oblique to the length direction crossing manner in which the two groups are crossed to each other to make a diamond pattern, or the monofilaments are arranged parallel in one direction to make a stripe pattern. In any cases, the monofilaments are arranged so as to give a density of 1 to 20 monofilaments/25 mm. The monofilaments may be arranged either on one surface of the web or on both the surfaces thereof and further may also be arranged inside the web.

The web having the monofilaments arranged is heat treated at the melt-adhesion temperature of the hot-melt-adhesive fibers or higher to integrate the monofilaments with the web. As the means for the heat treatment, known means such as hot air heating, heated rolls, etc. may be employed, but in order to ensure adhesion of the monofilaments to the web and also to cause the monofilaments to shrink sufficiently, two-stage heating employing contact bonding on heating by means of heated nip rolls and hot air heating under non-tension is preferred.

When the web containing the hot-melt-adhesive fibers are heat treated, the fibers constituting the web are bonded to one another to convert the web into a non-woven fabric, and at the same time, heat shrinkage generated in the monofilaments causes the web to shrink. Since this shrinkage is not due to shrinkage of the fibers themselves constituting the web, the resulting non-woven fabric becomes bulky; its surface has wrinkles of a wavelength of 0.1 to 20 mm over the whole surface; and these wrinkles do not extend even when tension is applied to the non-woven fabric. Further, due to the reinforcing effect brought about by the monofilaments, the non-woven fabric has a high strength.

The present invention will be described in more detail by way of Examples.

EXAMPLE 1

Composite fibers (hot-melt-adhesive fibers)(80% by weight) obtained by melt-spinning a crystalline polypropylene (m.p.: 163° C.) together with a high density polyethylene (m.p.: 135° C.) in a composite ratio of 50/50 in side-by-side type, and having a fineness of 3 deniers and a fiber length of 64 mm were blended with rayon (2 deniers, 51 mm) (20% by weight), followed by carding the resulting blended fibers to prepare a web, and subjecting this web to pretreatment by means of a hot-air-passing heater at 140° C. for 1.5 minute. The web after the pretreatment had a basis weight of 30 g/m$^2$, a longitudinal strength of 4,500 g/5 cm, a lateral strength of 800 g/5 cm and an elongation at breake of 41%. In addition, the strengths were measured according to JIS L 1085 (testing method for non-woven interlining fabrics).

A random terpolymer (softening point: 110° C. and m.p.: 140° C.) consisting of ethylene/propylene/butene-1 (3.5/92.0/4.5% by weight, respectively) and a high density polyethylene (softening point: 110° C. and m.p.: 135° C.) were subjected to composite spinning in a composite ratio of 50/50 in side-by-side type, followed by water cooling to obtain unstretched composite monofilaments, and stretching the monofilaments to 1.5 times the original length at room temperature to obtain monofilaments having a fineness of 220 deniers. When the monofilaments were heated at 140° C. for one minute, the resulting monofilaments had a percentage of shrinkage of 45% and a strength after shrinkage of 3.2 g/d.

The monofilaments were arranged between two sheets of the above-mentioned pretreated webs at a density of 4.2 monofilaments/25 mm both in the longitudinal direction and in the lateral direction, followed by preliminarily contact-bonding the whole by means of heated calender rolls of 135° C. under a liner pressure of 20 Kg/cm and at a speed of 15 m/min, and successively subjecting the resulting material to heat treatment by means of a hot-air-passing-through type heater at 145° C. under non-tension state for one minute and 50 seconds to obtain a bulky non-woven fabric. This bulky non-woven fabric had wrinkles of a wavelength (distance between adjacent wrinkles) of about 1.5 mm over the whole surface thereof, a thickness of 1.5 mm, a break strength of 13,090 g/5 cm in the longitudinal direction, that of 4,805 g/5 cm in the lateral direction, an elongation at breake of 61% in the longitudinal direction and that of 68% in the lateral direction.

COMPARATIVE EXAMPLE 1

Two sheets of the web after pretreatment used in Example 1 were placed on each other, followed by heated calender rolls treatment and heat treatment by means of a hot-air-passing-through type heater as in the case of Example 1 to obtain a non-woven fabric, and in this example, no monofilament was used. The resulting non-woven fabric had a thickness of 0.3 mm, a break strength of 8,200 g/5 cm in the longitudinal direction, that of 1,200 g/5 cm in the lateral direction, an elongation at breake of 42% in the longitudinal direction and that of 48% in the lateral direction.

EXAMPLE 2

Composite fibers (hot-melt-adhesive fibers) of a fineness of 2.5 deniers and a fiber length of 64 mm, obtained by melt-spinning a crystalline polypropylene (m.p.: 163° C.) as the core component thereof and a high density polyethylene (m.p.: 135° C.) as the sheath component thereof in a composite ratio of 50/50 were carded into a web, followed by subjecting the web to pretreatment by means of a hot-air-passing-through type heater at 140° C. for 1.5 minute. The resulting web after pretreated had a basis weight of 20 g/m$^2$ and a thickness of 0.2 mm.

A random copolymer (MFR: 8, softening point: 130° C. and m.p.: 145° C.) consisting of ethylene and propylene (2.5/97.5% by weight, respectively) was singly melt-spun, followed by water cooling, stretching the resulting unstretched monofilaments to 2.0 times the original length at room temperature to obtain monofilaments having a fineness of 30 deniers. When the monofilaments were heat treated at 135° C. for one minute, the resulting monofilaments had a percentage of shrinkage of 51% and a tenacity after shrinkage of 4.9 g/d.

The monofilaments were arranged on the upper surface of the above-mentioned pretreated webs at a density of 3 monofilaments/25 mm only in the longitudinal direction, followed by preliminarily contact-bonding the whole by means of heated calender rolls of 135° C. under a linear pressure of 10 Kg/cm and a rate of 8 m/min. and successively subjecting the resulting material to heat treatment by means of a hot-air-passing-through type heater at 140° C. under non-tension state for one minute and 10 seconds to obtain a bulky non-woven fabric. This bulky non-woven fabric had lateral wrinkles of a wavelength (distance between adjacent wrinkles) of about 1.5 mm, a thickness of 0.9 mm, a break strength of 3,950 g/5 cm in the longitudinal direction, that of 1,020 g/5 cm in the lateral direction, an elongation at breake of 42% in the longitudinal direction and that of 50% in the lateral direction.

COMPARATIVE EXAMPLE 2

The web after pretreatment used in Example 2 was subjected to heated calender rolls treatment and heat treatment by means of a hot-air-passing-through type heater as in the case of Example 2 to obtain a non-woven fabric and in this example, no monofilament was used. The resulting non-woven fabric had a thickness of 0.15 mm, a break strength of 2,650 g/5 cm in the longitudinal direction, that of 465 g/5 cm in the lateral direction, an elongation at break of 46% in the longitudinal direction and that of 54% in the lateral direction.

We claim:

1. A bulky and reinforced non-woven fabric, comprising:

a web including 30 to 100% by weight of hot-melt-adhesive fibers and 70 to 0% by weight of fibers having a melting point higher than that of the hot-melt-adhesive component of said hot-melt-adhesive fibers; and reinforcing monofilaments adhered to said web to reinforce the non-woven fabric, the fibers constituting said web being adhered onto one another, and also said fibers constituting said web and said reinforcing monofilaments being adhered together through hot-melt adhesion, and said non-woven fabric having wrinkles which have been generated by heat shrinkage of said reinforcing monofilaments of a wavelength in terms of a distance between adjacent wrinkles of 0.1 to 20 mm over the whole surface of said non-woven fabric.

2. A bulky and reinforced non-woven fabric according to claim 1, wherein said hot-melt-adhesive fibers is selected from homogeneous fibers consisting of polyethylene, polypropylene and polyester, and composite fibers consisting of crystalline polypropylene/polyethylene, polyester/polyethylene and polyester/low-melting polyester.

3. A bulky and reinfoced non-woven fablic according to claim 1, wherein said monofilament consists of thermoplastic resin of the same kind as that of said hot-melt adhesive fibers.

4. A bulky and reinforced non-woven fabric according to claim 1, wherein said monofilaments are arranged uniformly over the whole surface of said web so as to give a density of 1 to 20 monofilaments /25 mm length of said web.

5. A process for producing a bulky and reinforced non-woven fabric, comprising the steps of:

arranging over the total surface of a web consisting of 30 to 100% by weight of hot-melt-adhesive fibers and 70 to 0% by weight of fibers having a melting point higher than that of the hot-melt-adhesive component of said hot-melt-adhesive fibers reinforcing monofilaments having a percentage of shrinkage of 20% or higher under heat treatment conditions for melting-adhering said hot-melt adhesive fibers;

adhering fibers constituting said web onto one another and also adhering said fibers constituting said web onto said reinforcing monofilaments through hot-melt adhesion; and causing said web to shrink through shrinkage generated in said reinforcing monofilaments.

6. A process for producing a bulky and reinforced non-woven fabric according to claim 5, wherein said hot-melt-adhesive fibers is selected from homogeneous fibers consisting of polyethylene, polypropylene or polyester, and composite fibers consisting of crytalline polypropylene/polyethylene, polyester/polyethylene and polyester/low-melting polyester.

7. A process for producing a bulky and reinforced non-woven fabric according to claim 5, wherein said monofilament consists of thermoplastic resin of the same kind as that of said hot-melt adhesive fibers.

8. A process for producing a bulky and reinforced non-woven fabric according to claim 5, wherein said monofilaments are obtained by stretching unstretched monofilaments prepared by melt-spinning thermoplastic resins at a stretch ratio of 1.5 to 2.5 times the original length at a room temperature.

* * * * *